US005927545A

United States Patent [19]

Pearson

[11] Patent Number: 5,927,545

[45] Date of Patent: Jul. 27, 1999

[54] MEDICATION DELIVERY CARTRIDGE

[76] Inventor: Walter G. Pearson, P.O. Box 4371, Pineville, La. 71361-4371

[21] Appl. No.: 08/948,284

[22] Filed: Oct. 10, 1997

[51] Int. Cl.[6] ..... B65D 83/04

[52] U.S. Cl. ..... 221/197; 206/534; 211/50

[58] Field of Search ..... 221/197, 211, 221/278; 206/528, 534, 535, 499, 526; 211/49.1, 50, 53

[56] References Cited

U.S. PATENT DOCUMENTS

| | | | |
|---|---|---|---|
| 2,636,432 | 4/1953 | Sherer | 211/50 |
| 3,057,473 | 10/1962 | Stern et al. | 206/534 |
| 3,362,530 | 1/1968 | Johnson | 206/535 |
| 3,721,339 | 3/1973 | Seyer | 206/499 |
| 3,737,026 | 6/1973 | Whitecar | 206/535 |
| 4,465,186 | 8/1984 | Meyers | 206/499 |
| 4,527,689 | 7/1985 | Meyers | 206/499 |
| 4,635,795 | 1/1987 | DeFlander et al. | 206/526 |
| 4,978,012 | 12/1990 | Meyers | 206/499 |
| 5,181,189 | 1/1993 | Hafner | 206/534 |
| 5,181,460 | 1/1993 | Gremelsbacker | 211/50 |
| 5,221,005 | 6/1993 | Hayward | 206/499 |
| 5,447,229 | 9/1995 | Lynch et al. | 206/499 |
| 5,458,952 | 10/1995 | Wagner et al. | 221/312 R |

*Primary Examiner*—William E. Terrell
*Assistant Examiner*—Patrick Mackey
*Attorney, Agent, or Firm*—Warner J. Delaune

[57] ABSTRACT

A medication delivery cartridge for dispensing unit dose medication packages is provided, comprising a base; a plurality of support members extending upwardly from the base, the support members being shaped and dimensioned to hold a plurality of unit dose medication packages; and an attachment device on the base for allowing the cartridge to be installed within a medication delivery system. Preferably, the medication delivery cartridge further includes a removable retaining device connected to each of the support members, wherein the retaining device is shaped and dimensioned to retain the unit dose medication packages within the cartridge prior to installation of the cartridge within the medication delivery system. Also, a bar code or other identifying indicia are located on the cartridge corresponding to the particular unit dose medication packages within the cartridge, wherein the identifying indicia are readable by the medication delivery system. The cartridges are preloaded by the medication supplier, and are intended for vertical retrieval of unit dose medication packages from the top-most package downward until the supply of packages within the cartridge is exhausted.

9 Claims, 4 Drawing Sheets

MEDICATION DELIVERY CARTRIDGE

BACKGROUND OF THE INVENTION

I. Field of the Invention

The present invention relates generally to medication delivery systems, and more particularly to cartridges and specially designed unit dose medication used for filling automated medication delivery systems.

II. Description of Prior Art

Medication in the form of pills is contained and delivered in a wide variety of forms, including bulk containers, prescribed dosage containers, and unit dose packages. While bulk containers and prescribed dosages containers hold a plurality of pills for use by the consumer, unit dose medication packages, or so-called "blister packs", hold a single pill or dose. Unit dose packages are typically constructed from a flat sheet of laminated paper and plastic which includes a thin plastic enclosure, or "blister", which holds the pill. These unit dose packages are advantageous for a variety of reasons. For example, multiple unit dose packages can be attached to one another in the form of a sheet and economically delivered in boxes. The airtight seal for each pill allows for longer storage of the medication for use over extended periods of time, and it prevents medical care personnel from having to touch the medication before it is delivered to a patient. This is especially important in situations where the medical care personnel are handling numerous types of medication, and where patients may have a hypersensitivity to certain medications.

Because of their relatively nonuniform shape, however, automated delivery of unit dose medication packages has been an elusive goal. Automated medication dispensing devices have been developed for certain forms of medication, namely the dispensing of single pills from bulk containers, such as my prior invention represented by U.S. Pat. No. 5,292,029, the disclosure of which is incorporated herein by reference. In that device, single pills are retrieved from a bulk container by a suction probe that is capable of traveling along three axes. The shape of the probe and the individual pills makes retrieval by suction quite reliable. In theory, it is possible to retrieve a single unit dose package by suction, but only if the package is oriented so that a flat portion of the package is substantially perpendicular to the suction probe. Therefore, a bulk container having multiple, unusually oriented unit dose packages would not be a viable container for such medication if retrieval of single packages is desired.

Consequently, there is a broad need for the automatic dispensing of single unit dose medication packages, especially in connection with automated devices such as my prior patent mentioned above. One means of allowing for such automated dispensing is to provide a cartridge which houses a plurality of unit dose packages which are oriented in a manner to facilitate retrieval by suction or other means. The cartridge should be readily alignable and attachable within an automated delivery system so as to allow retrieval of unit dose medication packages, preferably without modification to any existing suction probe unit and without any other major functional and structural changes to the delivery system. The cartridges should be relatively simple and inexpensive to manufacture by the medication supplier so that pre-filled cartridges may be provided to users of the automated delivery system. A bar code or other means of identifying the medication should be conveniently located on the cartridge so that the automated delivery system can correlate the particular medication type with a specific location within the automated delivery system.

SUMMARY OF THE INVENTION

It is therefore an object of this invention to provide a medication delivery cartridge which is capable of holding a plurality of unit dose medication packages.

It is also an object of this invention to provide a medication delivery cartridge which is simple and inexpensive to manufacture so that it can be pre-loaded by the medication supplier.

It is a further object of this invention to provide a medication delivery cartridge which can be installed for use within an automated medication delivery system.

Yet another object of this invention is to provide a medication delivery cartridge which allows trouble-free retrieval of unit dose medication packages.

These and other objects and advantages of the present invention will no doubt become apparent to those skilled in the art after having read the following description of the preferred embodiment which are contained in and illustrated by the various drawing figures.

Therefore, in a preferred embodiment, a medication delivery cartridge for dispensing unit dose medication packages is provided, comprising a base; a plurality of support members extending upwardly from the base, the support members being shaped and dimensioned to hold a plurality of unit dose medication packages; and an attachment device on the base for allowing the cartridge to be installed within a medication delivery system. Preferably, the medication delivery cartridge further includes a removable retaining cap connected to the support members, wherein the retaining cap is shaped and dimensioned to retain the unit dose medication packages within the cartridge prior to installation of the cartridge within the medication delivery system.

In one embodiment of the invention, the support members include four vertical posts, each post having a pair of flanges forming an included angle therebetween, and wherein each post is positioned on the base such that the included angle of each post is capable of receiving a corner of the unit dose medication package.

In another embodiment, support members include first and second vertical posts positioned on the base adjacent to one another, with each of the first and second posts having a pair of flanges forming an included angle therebetween, wherein each of the first and second posts is positioned on the base such that the included angle of each of the first and second posts is capable of receiving a corner of the unit dose medication package; and a third vertical post positioned on the base such that the third post matingly engages a recess formed into the unit dose medication package.

In a further embodiment, support members include a pair of vertical posts positioned on the base such that the posts matingly engage two recesses formed on opposing sides of the unit dose medication package.

The cartridge is designed so that the attachment device comprises at least one attachment member shaped and dimensioned to matingly engage a corresponding receiving member on the medication delivery system, so that alignment with existing retrieval mechanisms can be preserved with a minimum of modification. Preferably, some form of identifying indicia, such as a bar code, are located on the cartridge corresponding to the particular unit dose medication packages within the cartridge, wherein the identifying indicia are readable by the medication delivery system.

DETAILED DESCRIPTION OF THE PREFERRED EMBODIMENTS

Figure 1:
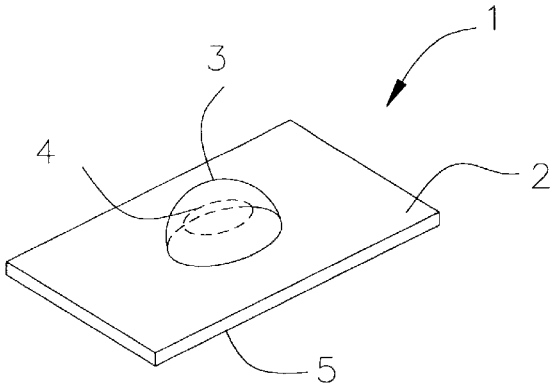
FIGURE 1 (PRIOR ART)
FIG. 1 is a perspective view of a typical prior art unit dose medication package.

Turning now to FIG. 1, a perspective view of a typical prior art unit dose medication package 1 is shown to comprise a base 2 in the form of a plastic sheet. The base 2 includes a raised portion or "blister" 3 which is shaped to contain a single pill 4 or dose of medication. As is common in the art of medication packaging, the blister 3 is enclosed by another backing layer 5 of foil or paper so that pill 4 can be retained therein. Backing layer 5 often includes information about the medication, such as the name, dosage and manufacturer. Removal of the pill 4 from the package 1 requires pushing on the blister 3 until the pill 4 breaks open the backing layer 5.

Figure 2:
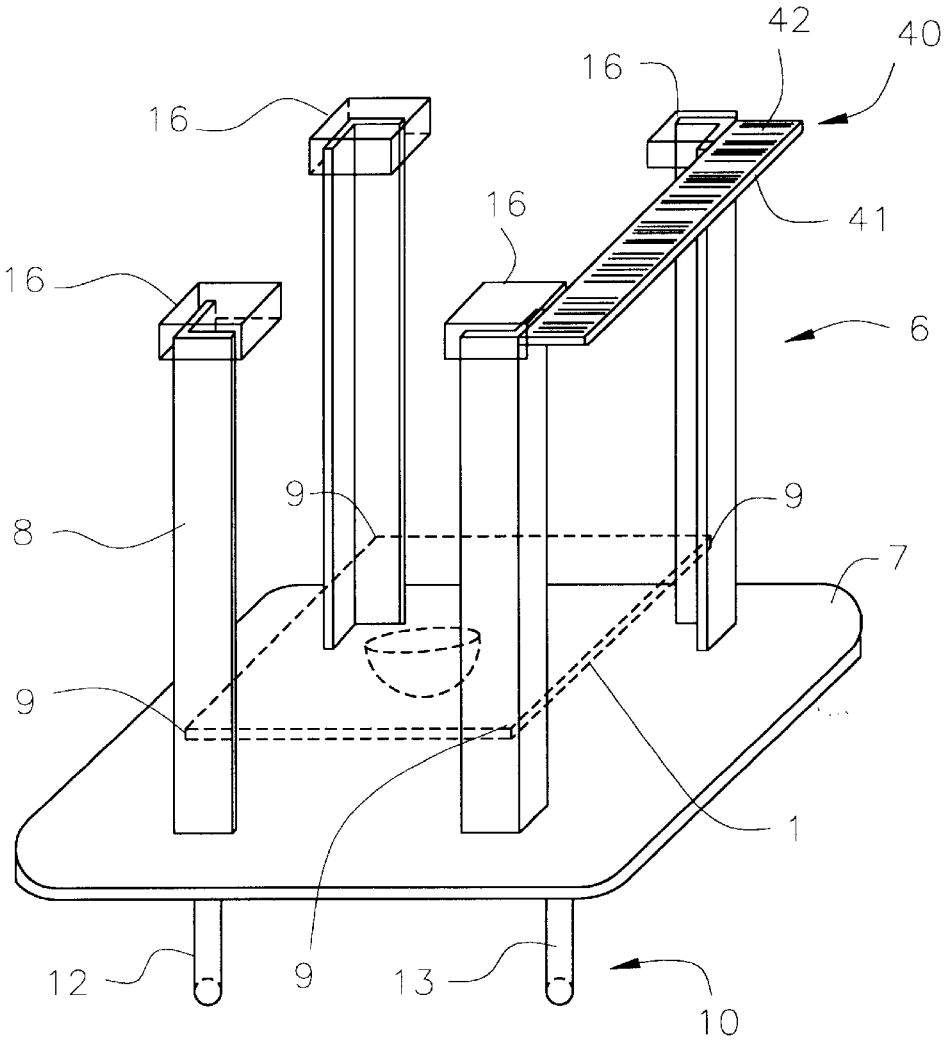
FIG. 2 is a perspective view of a preferred embodiment of the medication delivery cartridge depicting the orientation of a single unit dose package.

FIG. 2 is a perspective view of a preferred embodiment 6 of the medication delivery cartridge depicting the orientation of a single unit dose package 1. Although only one unit dose package 1 is shown in phantom lines within the cartridge 6 for clarity, it will be understood that any number of such packages 1 may be contained therein, limited only by the size of the cartridge 6 and/or the automated delivery system. The unit dose package 1 is shown oriented so that the blister 3 is facing down, and the backing layer 5 is facing up. As will be explained in further detail herein, this orientation is necessary so that the suction probe or other retrieval mechanism of the automated delivery system can acquire a flat surface of the unit dose package 1. For example, in the automated delivery system of U.S. Pat. No. 5,292,029, which is incorporated herein by reference, the open end 112 of the suction tube 104 is able to establish a more reliable suction grip on the backing layer 5 of the unit dose package 1.

Cartridge 6 includes a mounting base 7 having a plurality of vertical support members 8, in this case four, extending upwardly from the mounting base 7. The vertical support members 8 are shaped and dimensioned to hold a plurality of unit dose medication packages 1. As shown in FIG. 2, each vertical support member 8 includes an L-shaped cross section, wherein the included angle of the L-shape of each vertical support member 8 is capable of receiving a corner 9 of the unit dose medication package 1. In this arrangement, the unit dose package 1 is prevented from movement and rotation in a horizontal plane, but is free to be removed from the cartridge 6 along a vertical line of travel with the retrieval mechanism.

Figure 3:
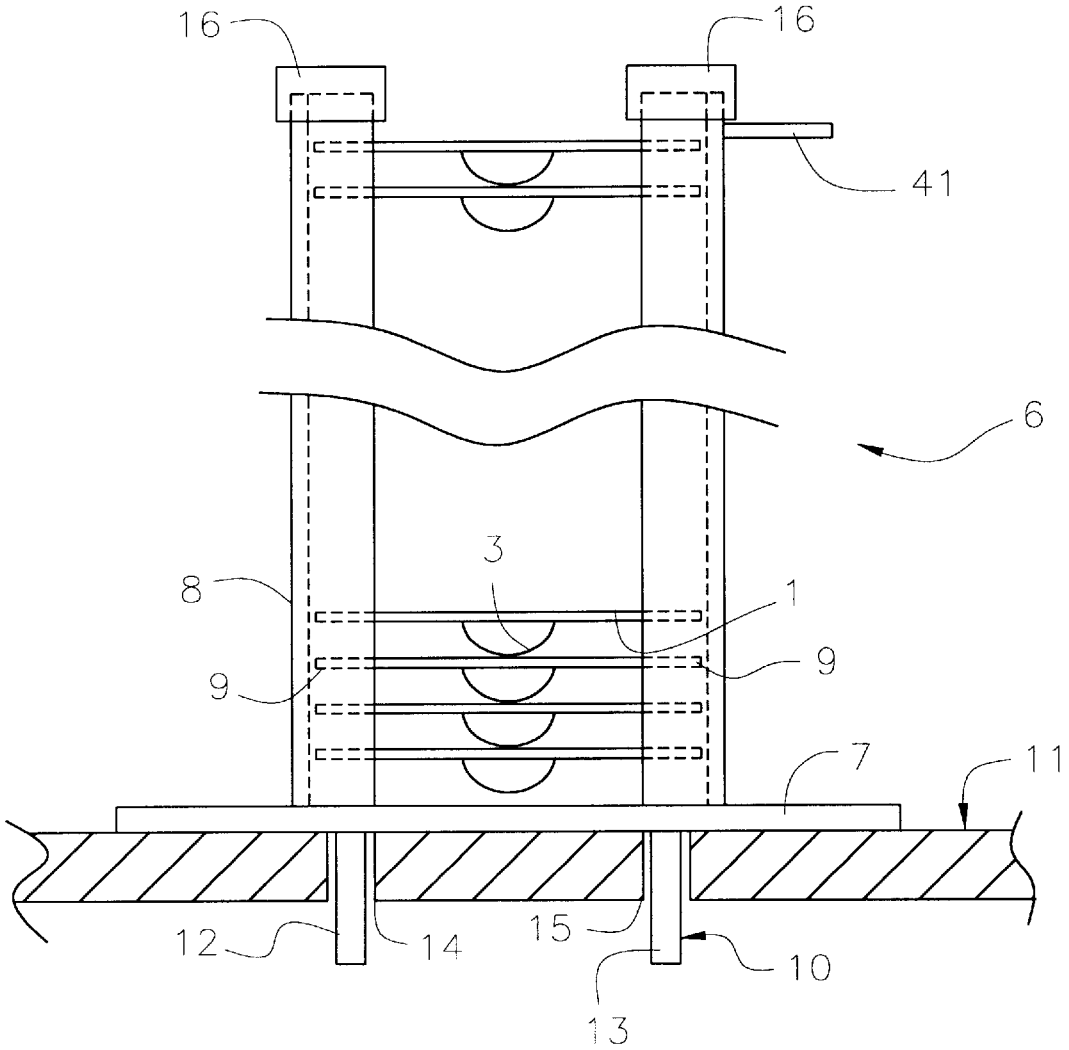
FIG. 3 is an elevation view of the cartridge of FIG. 2, illustrating the stacking of multiple unit dose packages, as well as installation of the cartridge within a delivery system.

The cartridge 6 also includes an attachment means 10 on the mounting base 7 for allowing the cartridge 6 to be installed within the automated delivery system 11, as more clearly shown in FIG. 3. While attachment means 10 is simply shown as a pair of downwardly extending posts 12,13, it is anticipated that a wide variety of means may be used to secure the cartridge 6 within the delivery system 11. For example, the embodiment of FIG. 3 simply indicates that the downwardly extending posts 12,13 are inserted into corresponding holes 14,15 in the delivery system 11. However, one may also employ clips (not shown) which hold the edges of the mounting base 7. Whichever arrangement is used, attachment means 10 should establish a discrete and precisely defined point within the delivery system 11 for that particular cartridge 6, and it should keep the cartridge 6 in a relatively stable position for retrieval of the packages 1 during operation. FIG. 3 also illustrates the stacking of multiple unit dose packages 1, where the broken line depiction of the cartridge 6 indicates that the cartridge 6 may be of any suitable height within the retrieval limitations of the delivery system 11.

For ease of storage, transportation and installation, each vertical support member 8 includes a removable retaining cap 16 which serves to prevent undesired dislodgement of the unit dose packages 1 from the cartridge 6. Because the corners 9 of the package 1 are closely mated to the vertical support members 8, the retaining caps 16 keep the packages 1 within the cartridge 6 by contacting the corners 9. Persons of ordinary skill will appreciate that the embodiment of the retaining caps 16 shown in the figures are simply one means of retaining the packages 1. As an alternative, the packages 1 may be retained by a single cap attached to all of the support member 8, or by any other removable device which prevents the packages 1 from leaving the cartridge 6. One example of an alternative retaining device would be a simple rubber band (not shown) wrapped on one end around the base 7 and on the other end around the uppermost package 1 in the cartridge 6. In either case, the retaining caps 16 or other removable retaining device are removed immediately before or after installation, so that the retrieval mechanism of the delivery system 11 can remove the packages 1. FIG. 3 illustrates a situation wherein the cartridge 6 has been installed, and the retaining caps 16 are ready to be removed prior to operation of the delivery system 11.

Figure 4A:
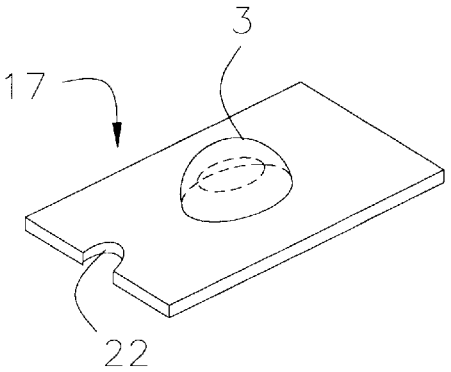
FIGS. 4A, 4B and 4C depict specially modified unit dose medication packages for use in alternate embodiments of the present invention.
Figure 4B:
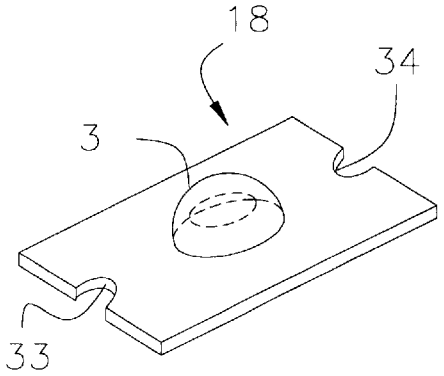

FIGS. 4A and 4B depict specially modified unit dose medication packages 17,18, respectively, for use in the following alternate embodiments of the present invention shown in FIGS. 5A and 5B, respectively. FIG. 5A illustrates a cartridge 20 very similar to the previous embodiment, but having only two vertical support members 8 having L-shaped cross sections. A third vertical support member 21 having a circular or other non-round cross-section is positioned opposite the L-shaped support members 8, such that the third vertical support member 21 is matably engageable with a recess 22 formed into one side of the unit dose medication package 17. The shape and dimensions of recess 22 should be such that the package 17 is loosely retained against the third vertical support member 21 and prevented from rotation away from the other two vertical support members 8.

Figure 5C:
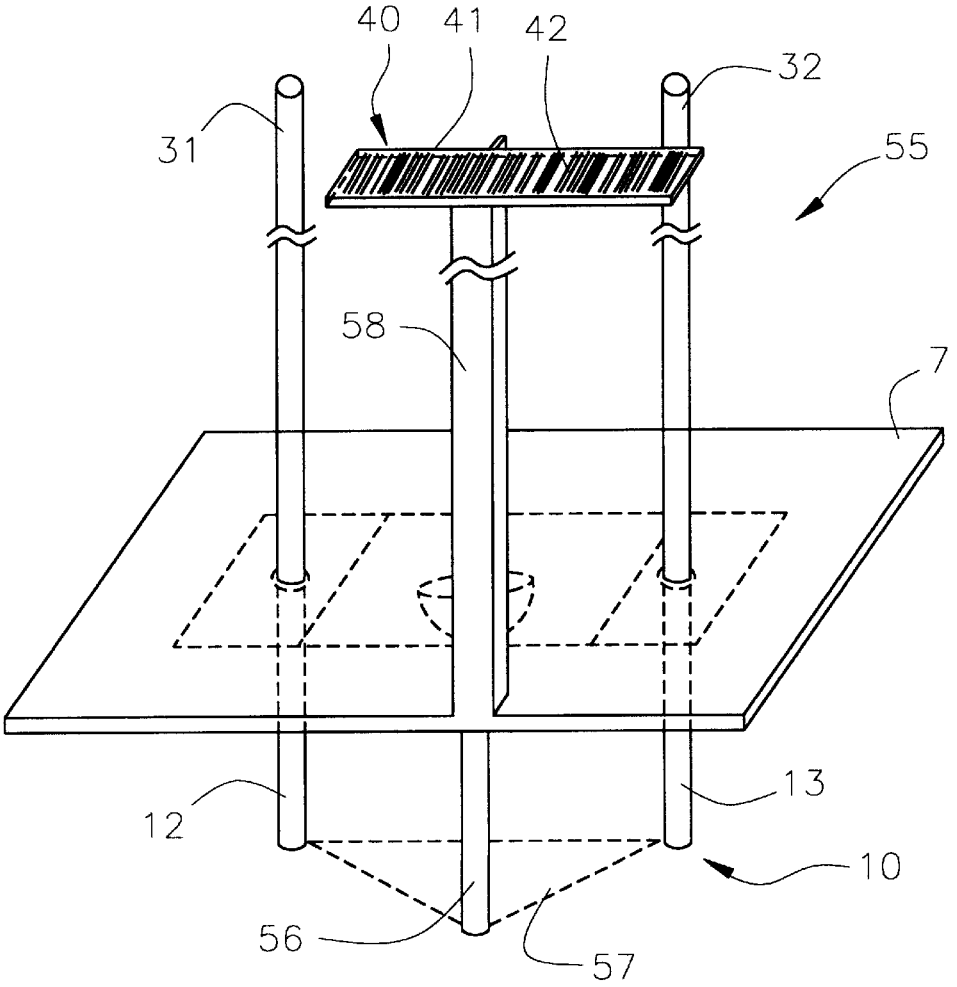
FIGS. 5A, 5B and 5C depict alternate embodiments of the medication delivery cartridge which retain the unit dose medication packages of FIGS. 4A, 4B, and 4C, respectively.
Figure 5A:
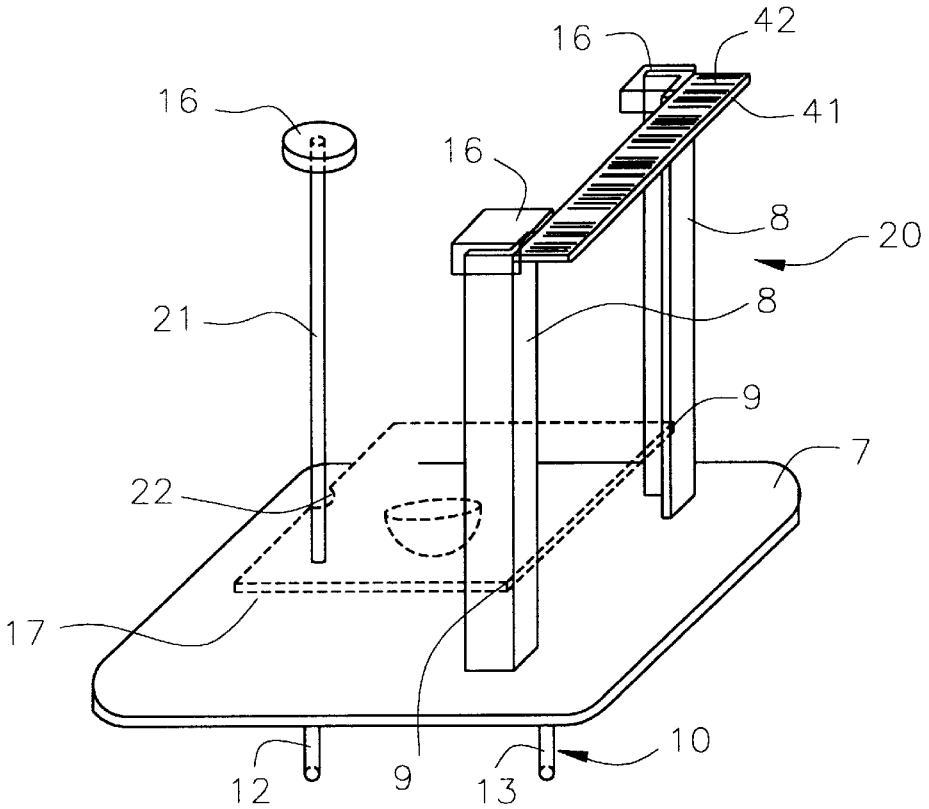
Figure 5B:
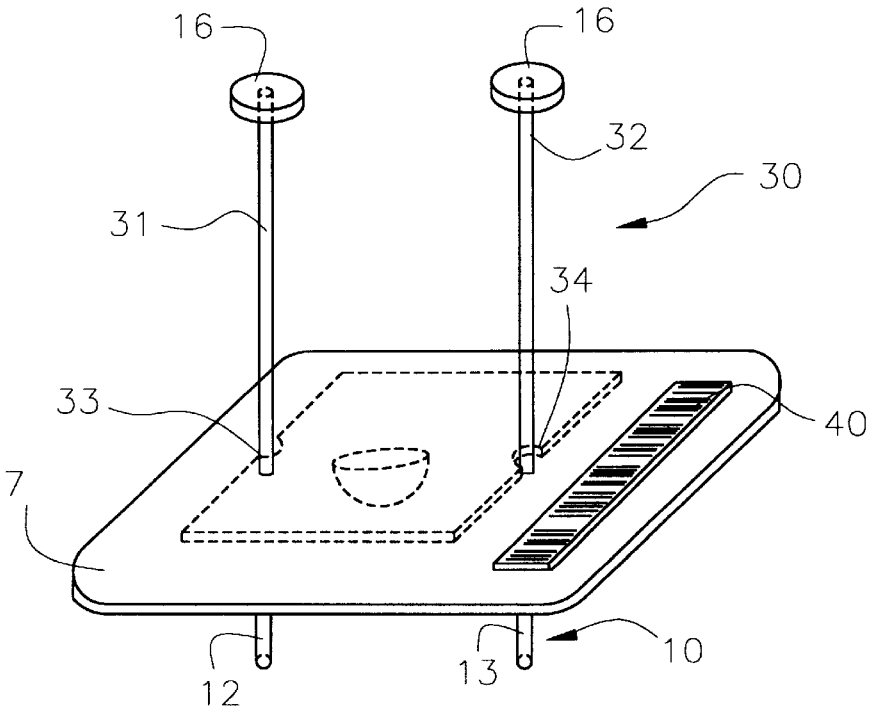

FIG. 5B shows another alternate embodiment 30 of the invention which employs only two vertical support members 31,32, and which engages the specially designed unit dose package 18 by virtue of two recesses 33,34 formed on opposite sides of the package 18. Recesses 33,34 are identical to recess 22 of unit dose package 17, and they are matably engageable with the two vertical support members 31,32 so that the unit dose package 18 is loosely retained.

Figure 4C:
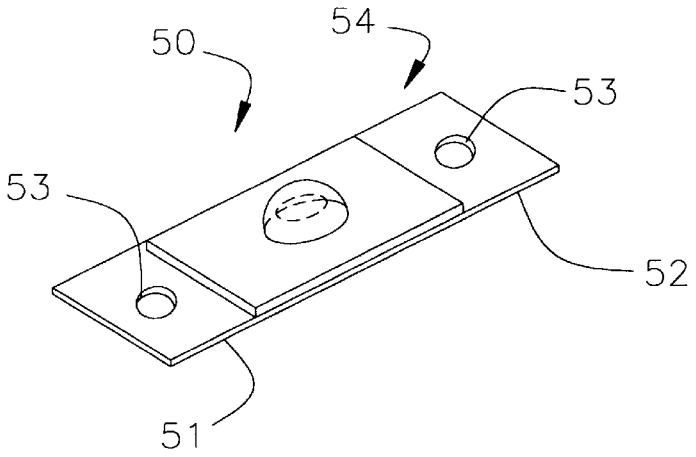

FIG. 4C is an illustration of another unit dose medication package 50 which has been modified for use with the present invention. Medication package 50 is preferably of unitary construction and identical to the standard unit dose packages available from the medication manufacturer, except for the addition of the two laterally extending flanges 51,52. Each flange 51,52 includes a hole 53 which is large enough to accommodate the upwardly extending posts 31,32 of a cartridge, as described previously herein. As an alternative to the preferred unitary construction, medication package 50 may alternatively be constructed from a standard unit dose medication package 1, such as that shown in FIG. 1, with the addition of a thin, transparent backing sheet 54 affixed by adhesive means to the backside of the package 1. Backing sheet 54 includes the flanges 51,52 and holes 53 previously described such that the medication package 50 is functionally identical to the embodiment of unitary construction.

FIG. 5C illustrates a further alternative embodiment 55 of the invention which is similar to FIG. 5B. An outline of the medication package 50 of FIG. 4C is shown installed within the cartridge 55. In this embodiment, however, the attachment means 10 includes a third downwardly extending post 56 which is offset from the other two downwardly extending posts 12,13. These three posts 12,13,56 define a triangular plane 57 wherein the third post 56 serves as an orientation post. Orientation of the cartridge 55 is important for reasons of placing the cartridge within the delivery system 11 so that the delivery system can read a properly positioned identifying indicia associated with the particular medication, as explained further below. Although orientation of the cartridge through the use of three posts is described, it should be understood that even a single, uniquely shaped downwardly extending member may be sufficient to attach any of the aforementioned cartridges to the delivery system 11 in the proper orientation.

To enable identification of the medication, each cartridge 6,20,30,55 includes some form of identifying indicia 40 which is readable by the automated delivery system 11. For example, in cartridges 6 and 20 of FIGS. 2, 3 and 5A, a short indicia support member 41 extends from two vertical support members 8 and includes a unique bar code 42 corresponding to a particular type and dosage of medication within the unit dose packages 1. A similar indicia 40 is attached to the mounting base 7 of the cartridge 30 of FIG. 5B so that an indicia support member 41 does not interfere with removal of the packages 18 from the cartridge 30. In FIG. 5C, a third upwardly extending post 58 is located on one side of the base 7 and supports an indicia support member 41 and bar code 42. Although bar code indicia is preferred, any other convenient means of automatically associating the particular medication, such as a magnetic strip having similar information, would be appropriate. Once the cartridges are installed, the automated delivery system 11 is programmed to scan each cartridge and record into memory the identifying data 40 read from the cartridges, thereby establishing the identification of the particular medication available at each discrete location within the automated delivery system 11.

The alternative design for the unit dose medication packages 17,18,50 should be easily accomplished by the medication manufacturers, so that the medication can be preloaded into the cartridges prior to shipment to the operators of the automated delivery system 11. Therefore, use of the present invention would be made extremely simple, because each pre-loaded cartridge could be quickly installed and used upon removal of any retaining devices, such as a rubber band or the retaining caps 16.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. A medication delivery cartridge for dispensing unit dose medication packages, comprising:

(a) a base;

(b) a plurality of support members extending upwardly from said base;

(c) at least one unit dose medication package shaped and dimensioned to matably engage said support members;

(d) attachment means on said base for allowing said cartridge to be installed within a medication delivery system; and (e) fixed and machine-readable identifying indicia operatively attached to said cartridge corresponding to said unit dose medication packages.

2. The medication delivery cartridge of claim 1, further comprising a removable retaining cap connected to at least one of said support members, wherein said retaining cap is shaped and dimensioned to retain said unit dose medication packages within said cartridge prior to installation of said cartridge within said medication delivery system.

3. The medication delivery cartridge of claim 1, wherein said plurality of support members includes four vertical posts, each said post having a pair of flanges forming an included angle therebetween, and wherein each said post is positioned on said base such that said included angle of each said post is capable of receiving a corner of said unit dose medication package.

4. The medication delivery cartridge of claim 1, wherein said unit dose medication package includes at least one recess formed into said package, wherein said recess is shaped and dimensioned to receive one of said support members.

5. The medication delivery cartridge of claim 4, wherein said unit dose medication package includes two of said recesses formed on opposing sides of said package, and wherein said plurality of support members includes a pair of posts positioned on said base such that said posts matingly engage said recesses.

6. The medication delivery cartridge of claim 4, wherein said plurality of support members includes:

(a) first and second posts positioned on said base adjacent to one another, each of said first and second posts having a pair of flanges forming an included angle therebetween, wherein each of said first and second posts is positioned on said base such that said included angle of each of said first and second posts is capable of receiving a corner of said unit dose medication package; and (b) a third post positioned on said base such that said third post matingly engages said recess.

7. The medication delivery cartridge of claim 1, wherein said attachment means comprises at least one attachment member shaped and dimensioned to matingly engage a corresponding receiving member on said medication delivery system.

8. The medication delivery cartridge of claim 1, wherein said identifying indicia comprises a bar code.

9. The medication delivery cartridge of claim 1, wherein said unit dose medication package includes a pair of holes formed into said package, wherein said holes are shaped and dimensioned to receive said support members.

* * * * *